US005964580A

United States Patent [19]

Taga

[11] Patent Number: 5,964,580

[45] Date of Patent: Oct. 12, 1999

[54] POSITIVE DISPLACEMENT PUMP HAVING A RATCHET DRIVE GUIDE FOR DISPERSING CYCLIC COMPRESSION STRESSES OVER THE CIRCUMFERENCE OF AN INTERNAL FLEXIBLE MEMBER

[76] Inventor: Jun Taga, No.1-10, Minamiikuta 7-Chome, Tama-Kukawasaki-Shi, Kanagawa-ken, 214, Japan

[21] Appl. No.: 08/948,755

[22] Filed: Oct. 10, 1997

[30] Foreign Application Priority Data

Apr. 18, 1997 [JP] Japan ..... 9-115124

[51] Int. Cl.[6] ..... F04B 45/06

[52] U.S. Cl. ..... 417/394; 92/86; 92/92; 417/392; 417/478

[58] Field of Search ..... 417/394, 392, 417/393, 478; 92/86, 92

[56] References Cited

U.S. PATENT DOCUMENTS

| | | | |
|---|---|---|---|
| 2,405,734 | 8/1946 | Coe | 103/44 |
| 3,048,121 | 8/1962 | Sheesley | 103/152 |
| 3,062,153 | 11/1962 | Losey | 103/152 |
| 3,442,292 | 5/1969 | Jacuzzi et al. | 138/30 |
| 3,684,405 | 8/1972 | Wright et al. | 417/394 |
| 4,006,260 | 2/1977 | Webb et al. | 426/438 |
| 4,104,005 | 8/1978 | Poirier | 417/394 |
| 4,212,589 | 7/1980 | Bosio | 417/12 |
| 4,439,113 | 3/1984 | Owen | 417/394 |
| 5,209,654 | 5/1993 | Lofsjogard Nilsson et al. | 417/478 |

FOREIGN PATENT DOCUMENTS

| | | |
|---|---|---|
| 57-079279 | 5/1982 | Japan . |
| 7-123107 | 12/1995 | Japan . |

*Primary Examiner*—Charles G. Freay
*Assistant Examiner*—Robert Z. Evora
*Attorney, Agent, or Firm*—Barry R. Lipsitz; Ralph F. Hoppin

[57] ABSTRACT

A positive displacement pump includes a deformable hollow member for delivering a subject liquid by a cycle of contraction and restoration of its volume, a casing which contains the hollow member, and a pressurizing device for supplying and evacuating a hydraulic liquid in an annular space between the casing and the hollow member. The supplying of hydraulic fluid causes the contraction of the hollow member, and the evacuating of the hydraulic fluid causes the restoration (expansion) of the hollow member. A guide structure contacts and deforms the outer circumferential portions of the hollow member as the hollow member continues to expand to determine an initial contraction position of the hollow member. That is, a particular direction of contraction of the hollow member is set by the guide structure. Drive means periodically vary the circumferential position of the guide means relative to the hollow member to vary the initial contraction position of the hollow member. Consequently, stresses due to contraction and restoration are dispersed in the hollow member.

30 Claims, 16 Drawing Sheets

POSITIVE DISPLACEMENT PUMP HAVING A RATCHET DRIVE GUIDE FOR DISPERSING CYCLIC COMPRESSION STRESSES OVER THE CIRCUMFERENCE OF AN INTERNAL FLEXIBLE MEMBER

BACKGROUND OF THE INVENTION

1. Field of the Invention

This invention relates to a positive displacement pump for introduction and delivery of a subject liquid by repeatedly pressing a cylindrical hollow member containing the subject liquid in a direction normal to a diametric line of the hollow member into a flat or triangular shape in its radial cross section. Stresses on the hollow member due to the repeated depression and restoration are imposed symmetrically to prolong the life of the hollow member.

2. Prior Art

The density of semiconductor integrated circuits has been, and will soon be, made higher and higher from 16 MB to 64 MB, and further to 1 GB. Accordingly, more strict standards are requested in terms of allowance for impurities in semiconductors for making ultra-high-density integrated circuits.

For example, in case of chemical liquids used in the manufacturing process of semiconductors, particles of 0.1 mm in a chemical liquid should not exceed 20 per 1 $cm^3$, and particles of 0.05 mm should not exceed 10 per 1 $cm^3$.

In general, a filter is used to remove particles from a chemical liquid, and filtration using a filter needs a pressurizing pump with a certain performance.

Taking requirements on resistance to a high pressure and resistance to chemicals into account, recent technologies for manufacturing semiconductors use diaphragm pumps, bellows pumps, or the like, whose major parts are made of polytetrafluoroethylene (PTFE), which is a four-fluorine-contained polymer, together with filters for removing impurities from subject liquids.

These conventional pumps, however, involve the following problems. First, resistance to high temperatures and high pressures is insufficient for use in fabrication of semiconductors.

It is known that there is a certain relationship between the pressure of a subject liquid and the square of pores of a filter. Namely, according to the Hagen-Poiseuille law, if the square of pores of a filter is reduced to ½, the pressure of a subject liquid must be quadrupled to ensure the same flow amount.

For the reason mentioned above, filters used in fabrication of semiconductors are requested to have a pore size of 0.1 mm to 0.05 mm.

If a filter with the pore size of 0.1 mm is replaced by a filer with the pore size of 0.05 mm, the pump pressure must be raised by a factor of sixteen. Actually, however, the maximum outlet pressure of conventional pumps is 2 to 5 $kg/cm^2$ at 20° C. and 1 $kg/cm^2$ at 150° C., and pumps are operated at the maximum pressure. Thus, it is impossible to rely on any further increase in outlet pressure.

Therefore, when the square of pores of a filter is ½, units each containing a pump and a filter must be increased by a factor of sixteen to ensure the same filter outlet gain. An alternative way of increasing the filter-through efficiency is to increases the temperature of the subject liquid and decrease the viscosity of the liquid. However, at temperatures beyond 120° C., conventional pumps often loose their pumping function due to a thermal deformation of bellows, or other elements, caused by a decrease in rigidity.

A second problem with conventional pumps is that both diaphragm pumps and bellows pumps rely on deformation of diaphragms or bellows made of a plastic resin for suction and discharge of a subject liquid, and deformation of diaphragms or bellows always occurs at particular portions thereof. Therefore, stress cracking is liable to occur due to mechanical fatigue of their materials caused by repetitive bending motion and concentration of a high stress, and this can damage the pumps. To cope with the problem, conventional pumps are equipped with a leakage sensor for detecting leakage of a subject liquid. However, when the sensor detects leakage of the liquid, the pump has already been destroyed.

SUMMARY OF THE INVENTION

According to the invention, there is provided a pump comprising a hollow member made of an elastomer or other flexible resin, a pressure-resistant casing for containing the hollow member, pressurizing means for supplying and removing hydraulic fluid in a gap between the casing and the hollow member, guide means for contacting the hollow member to reduce its volume, and drive means for changing the position of the guide means relative to the hollow member.

When the hydraulic fluid is supplied to the casing from the pressurizing means, the hollow member is compressed by the hydraulic fluid with a high pressure and reduces its volume. As a result, the subject liquid contained in the hollow member is discharged from an outlet at a pressure which is substantially equal to that of the hydraulic fluid.

Subsequently, the pressurizing means stops pressurization and, in the next suction step, removes a predetermined amount of the hydraulic fluid from the casing. Thus, the interior pressure of the casing becomes negative, and a next lot of the subject liquid is introduced into the hollow member through an inlet. By repetition of these motions, suction and discharge of the subject liquid into and from the hollow member are executed.

Under the condition where the hollow member is filled with the subject liquid, the arms of the guide means are in press contact with certain portions of the outer circumferential surface of the hollow member such that opposite arc portions of the hollow member are depressed and exhibit straight lines in a cross-sectional view taken along a radial direction of the hollow member. As the high-pressure hydraulic fluid is introduced into the casing, depression of the hollow member progresses, and the volume of the hollow member is decreased. The drive means sequentially changes points of contact of the hollow member with the guide means for each pumping stroke so as to prevent concentration of the stress due to repetition of compression and restoration of the volume at particular portions of the hollow member.

Thus, the present invention realizes a positive displacement pump which is excellent in durability, high pressurizing function, resistance to high temperatures and resistance to chemicals, and including no portion causing stagnation of the subject liquid.

More specifically, since deformed portions (bent portions) of the hollow member change for each pumping cycle, the durability is increased relative to conventional bellows pumps, etc. Moreover, since the pressure that the pump can output is substantially equal to the pressure of the hydraulic fluid from the pressurizing means, a higher pressure than conventional diaphragm pumps, etc. can be realized easily by appropriately selecting the pressurizing means. Resistance to chemicals can be enhanced by selecting appropriate materials for the hollow member.

The pump according to the invention is free from degradation in pumping function due to a high temperature of the subject liquid which must be heated in some conventional bellows pumps or diaphragm pumps.

Additionally, the structure of the pump according to the invention permits construction of a large-scaled pump as compared with conventional diaphragm pumps and bellows pumps, for use in delivery of various things other than typical fluids, such as slurry, paste, fluid containing solid material, like liquid concrete, in a high pressure.

DETAILED DESCRIPTION OF THE PREFERRED EMBODIMENTS

Figure 1:
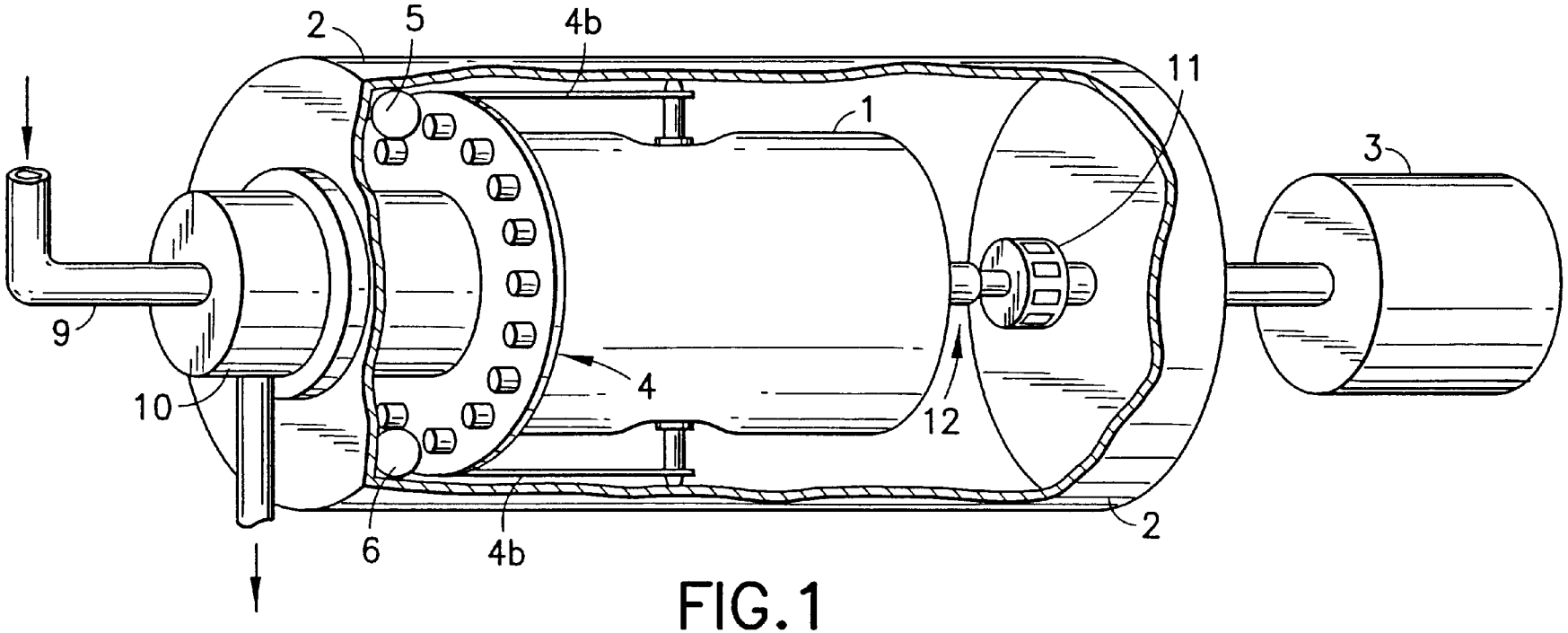
FIG. 1 is a perspective view of a pump according to an embodiment of the invention, in which an outer part is cut out to show the interior structure.

Explained below are embodiments of the invention with reference to the drawings. FIG. 1 is a perspective view showing a pump according to a first embodiment of the invention, in which reference numeral 1 denotes a cylindrical hollow member made of an elastic polymeric resin membrane of tetrafluorine resin, polyethylene, elastomer, or the like.

Numeral 2 denotes a cylindrical casing made of a hard resin material and having a resistance to high pressures. Numeral 3 denotes pressurizing means including a cylinder and a piston.

Numeral 4 denotes guide means contacting the outer wall of the hollow member 1 to determine the start position for depressing the hollow member and for reducing its volume. Numeral 5 denotes drive means for changing the position of the guide means 5 for contact with the hollow member 1. Numeral 6 denotes a pawl used as an element of the drive means 5.

Numerals 9 and 10 denote a suction tube and a delivery tube of the pump. The suction tube 9 extends into and beyond a central portion of the hollow member 1, preferably to terminate at a position very near to and slightly distant from one of ends of the hollow member 1. By positioning the suction tube 9 in this manner, retention of the subject liquid in the hollow member 1 can be prevented.

Numeral 11 denotes an in-out tube for the hydraulic fluid provided at an end of the casing 2. Numeral 12 denotes a support device which is interposed between one end of the hollow member 1 and the in-out tube 11 to support the hollow member 1. The support device 12 includes a tube secured to one end of the hollow member 1 and a centering rod inserted in the secured tube. The support device 12 facilitates displacement of this end of the hollow member 1 during depression and restoration of the hollow member 1.

Figure 2:
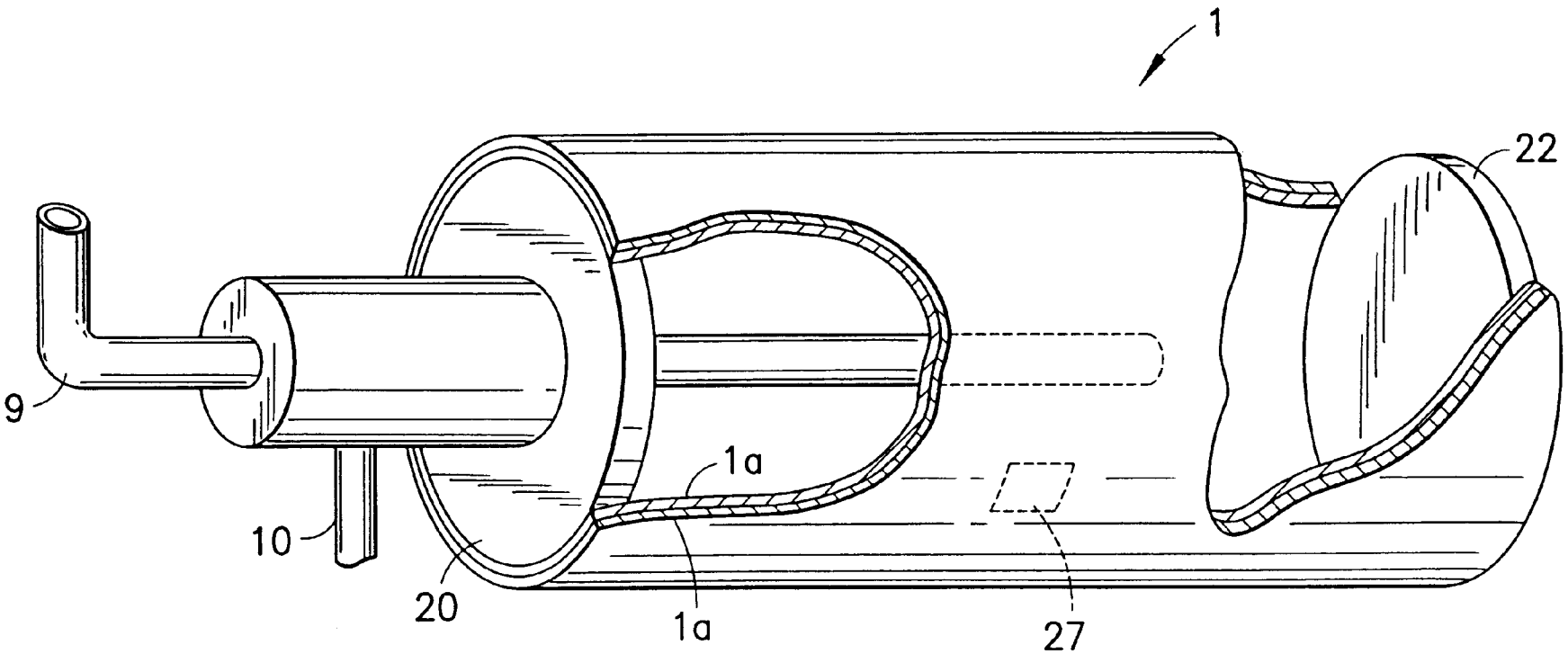
FIG. 2 is a perspective view of a hollow member, a part of which is cut out to show the interior structure.

FIG. 2 is a perspective view of the cylindrical hollow member 1 having circumferential walls 1*a*, 1*a* that are made of an appropriate one of the aforementioned resin materials in an appropriate thickness ensuring a sufficient elasticity or flexibility. A single-wall hollow member is also acceptable. Although a hollow member with a single wall 1*a* is also acceptable, this embodiment uses a double-wall structure to provide a leakage sensor 27 under seal between the first and second layers and to cope with any damage to one or the other of the double layers. In a typical version, the outer layer is thicker than the inner layer, or the outer layer is made of an elastomer with a larger flexibility than that of the inner layer, so that the outer layer is less likely to break than the inner layer.

The hollow member 1 also has end plates 20 and 22 in the form of thick resin plates.

Figure 3:
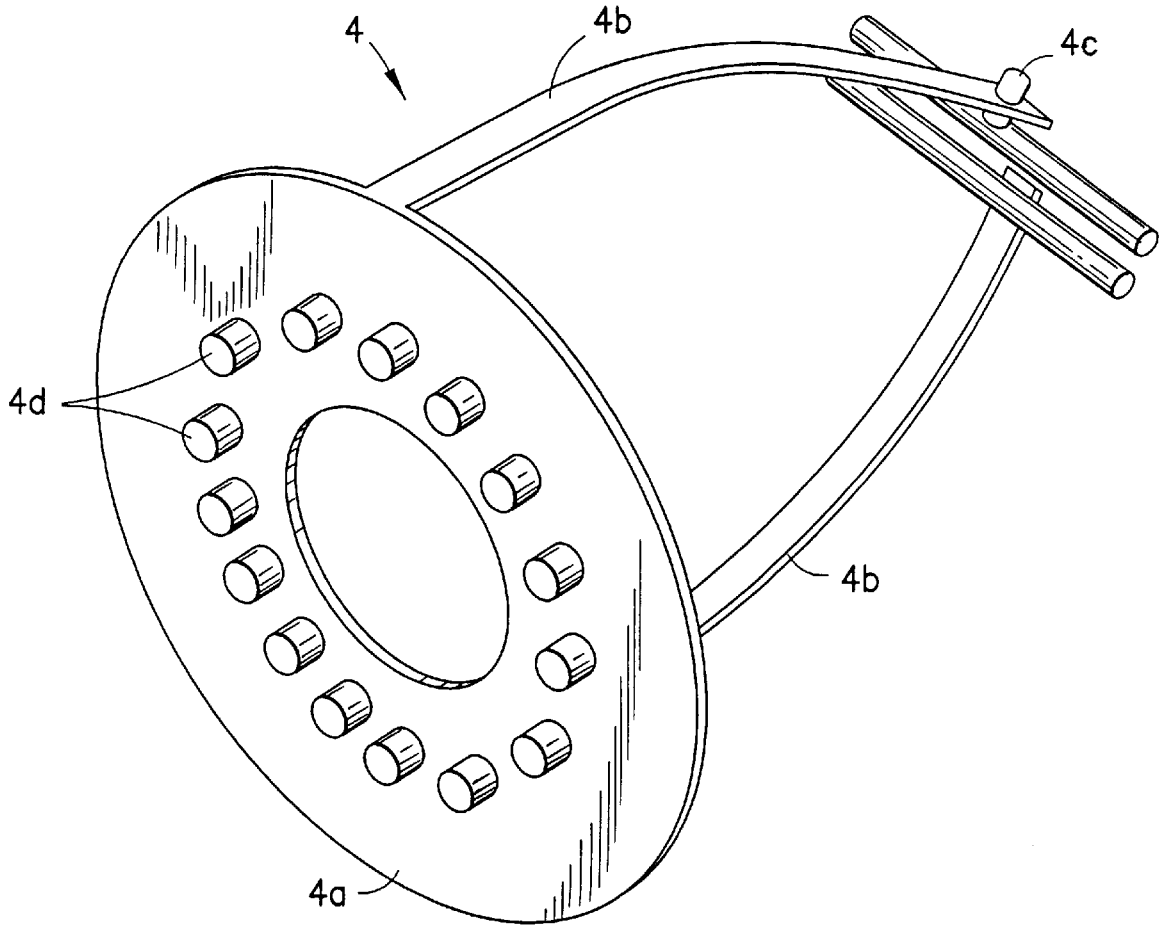
FIG. 3 is a perspective view of a structure of a guide means.

FIG. 3 is a perspective view of guide means 4 including a ring-shaped ratchet wheel 4*a*, a pair of arms 4*b*, 4*b*, and a plurality of projections 4*d*. The arms 4*b*, 4*b* are attached to symmetrical positions of the circumferential edge of the ratchet wheel 4*a*, and each arm 4*b* has formed a contact element 4*c* at its distal end. The guide means 4 is mounted such that the ratchet wheel 4*a* rotates at one end of the hollow member 1 and the contact elements lightly touches the outer circumferential wall of the hollow member 1 as shown in FIG. 1. The arms 4*b* are plate springs which keep contact with the outer circumferential wall of the hollow member 1 with a constant pressure while the hollow member 1 deforms from a cylindrical form to a depressed form. While the ratchet wheel 4*a* rotates, the arms 4*b*, 4*b* and their bars (contact elements) 4*c*, 4*c* change their positions relative to the hollow member 1 along its outer circumferential wall. The projections 4*d* are aligned along a circle on the ratchet wheel 4*a*. In this embodiment, the ratchet wheel 4*a* has 49 projections 4*d*, namely, an odd number of projections. An even number of projections are not preferable because the hollow member 1 bends at two portions in one cycle and, with fifty projections, for example, the hollow member 1 bends at 25 portions.

Figure 4:
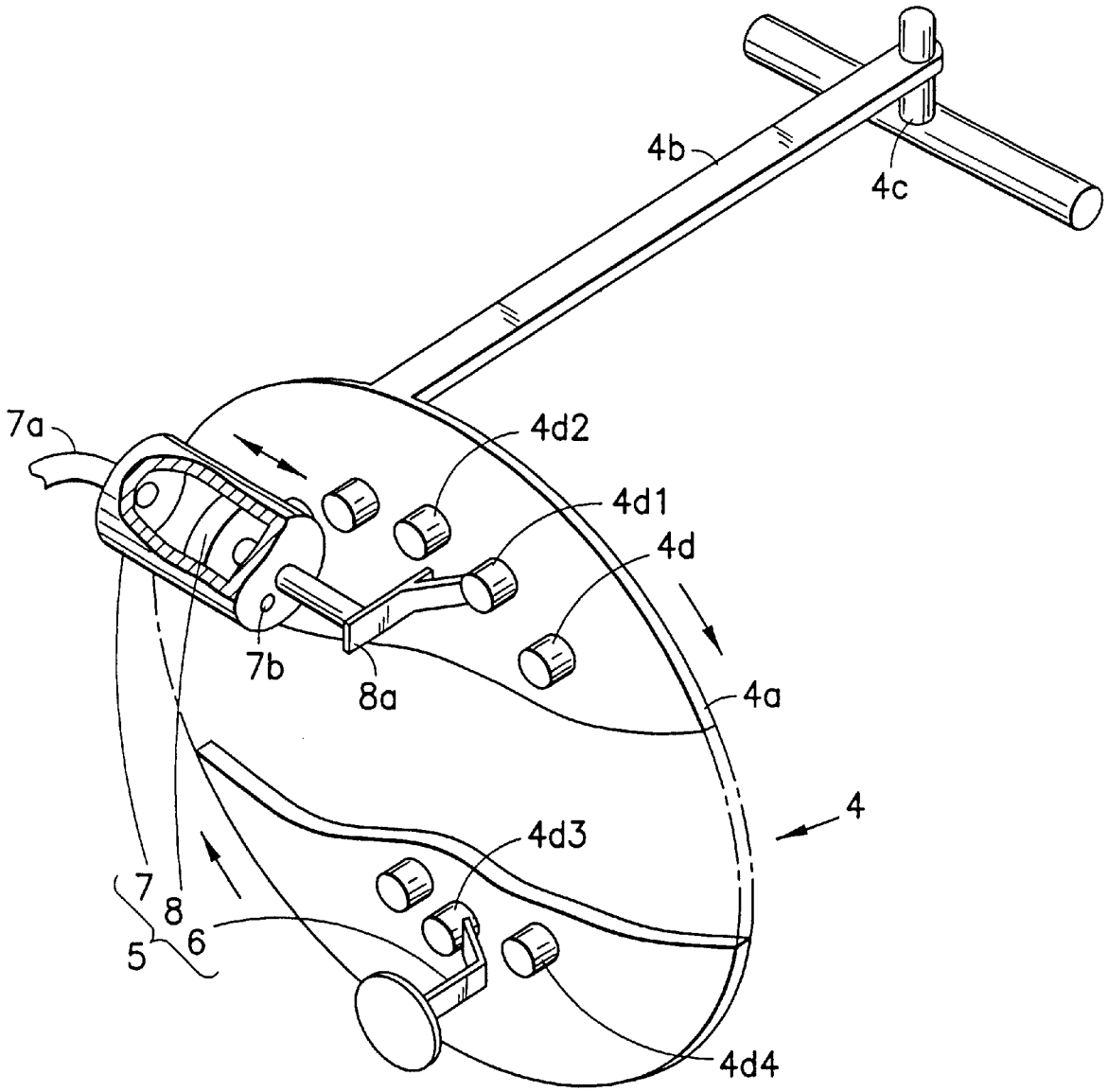
FIG. 4 is a perspective view of a structure including drive means, guide means and stoppers.

FIG. 4 is a perspective view showing the drive means 5 attached to the casing 2. The drive means 5 includes a cylinder 7, piston 8 and pawl 6. The cylinder 7 has a passage 7*a* formed in one of end plates and an orifice 7*b* formed in the other end plate to permit hydraulic fluid to reciprocally flow to and from the casing 2. The outer end of the passage 7*a* opens to the air. Since the pumps according to the invention are typically used in a doubly connected form in different phases, the outer end of the passage 7*a* may open to the interior of the casing of another pump (see FIG. 12).

The drive source of the drive means 5 is a liquid flowing to and from the casing 2. When a pressurized hydraulic fluid is supplied to the casing 2 from the liquid pressurizing means 3, the hydraulic fluid enters into the cylinder 7 from the orifice 7*b* and moves the piston 8 in a predetermined direction.

When the liquid is evacuated from the casing 2, the piston 8 moves in the opposite direction due to the atmospheric pressure through the passage 7*a*. If the passage 7*a* is connected to the casing 2 of another pump, the hydraulic fluid of the latter pump, in lieu of the atmospheric pressure, acts on the piston 8.

The piston 8 has a catch 8*a* bonded to its distal end. The catch 8*a* is an reshaped plate spring as shown in the drawing, and its longer bifurcated end contacts one of the projections 4*d* to rotate the ring-shaped ratchet wheel 4 with the aid of the piston 8. Also the pawl 6 is an reshaped plate spring, and its longer bifurcated end is in contact with the one of projections 4*d*. Although the drive means 5 is positioned inside the casing 2, it may be located outside the casing 2 for easier tubing.

Figure 5:
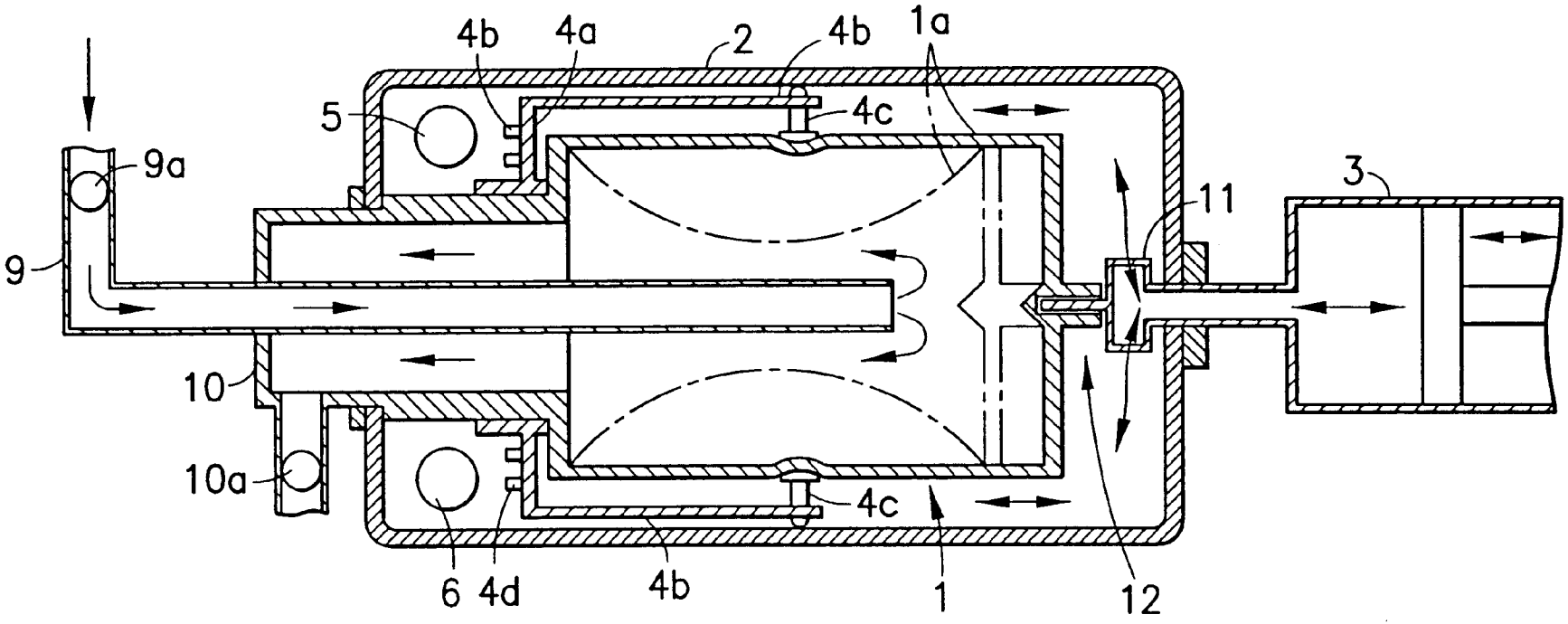
FIG. 5 is a cross-sectional view of the pump according to an embodiment of the invention.

FIG. 5 is a cross-sectional view showing relations among elements of the pump according to the invention. The hollow member 1 held in the casing 2 has an inlet 9 extending from one end thereof to introduce a subject liquid. Mounted on the inlet 9 is the ring-shaped ratchet wheel 4*a* for rotation around it. The contact elements 4*c*, 4*c* on tips of the pair of arms 4*b*, 4*b* attached to the ring-shaped ratchet wheel 4*a* are in contact with the outer circumferential wall of the hollow member 1 at a longitudinally intermediate position. Numeral 10 denotes an exit tube.

The liquid pressurizing means 3 is a plunger-type pump system using a cylinder and a piston.

Next explained are behaviors of the pump according to the embodiment with reference to FIG. 5, and others, if necessary.

Figure 6:
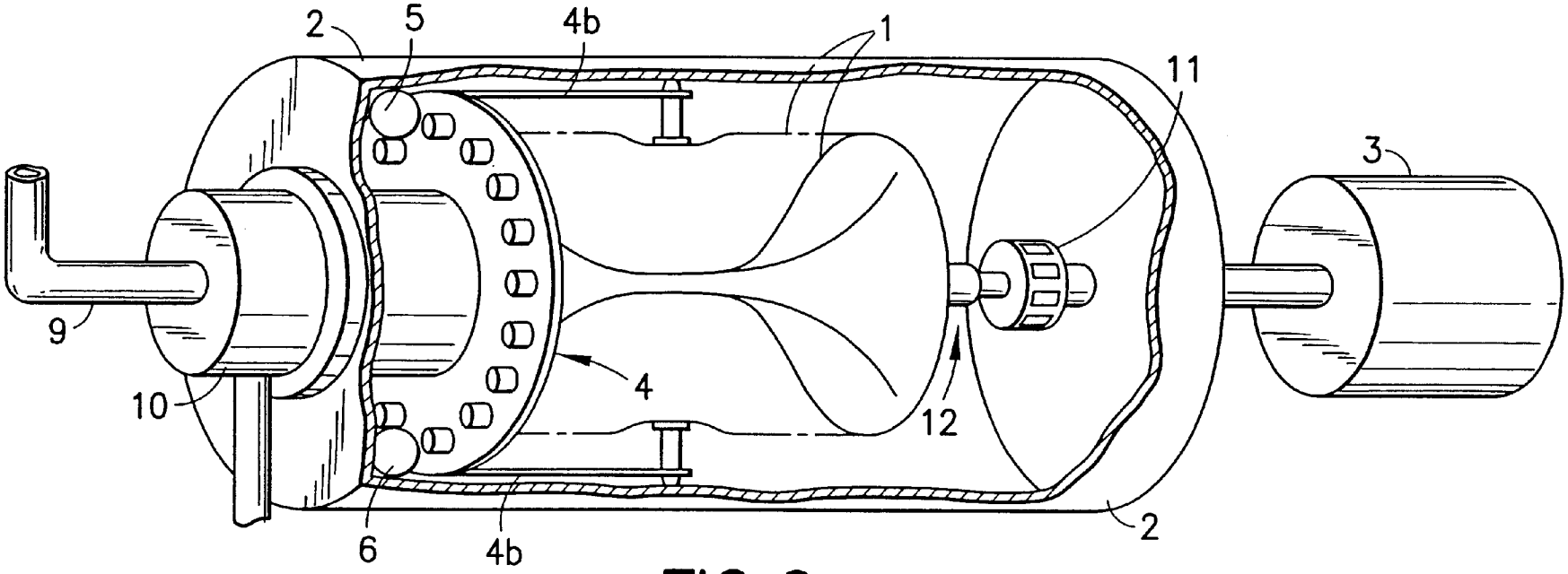
FIG. 6 is a perspective view of another structure of the hollow member in the embodiment of FIG. 1.

Explanation is started with behaviors of the hollow member 1. When the hydraulic fluid, e.g. silicone oil, fluorine oil, pure water, or the like, supplied from the pressurizing means 3 is introduced into the casing 2, the hollow member 1 is depressed by the hydraulic fluid and gradually deforms into a flat shape with less volume as shown in FIG. 6. The contour of the hollow member, when depressed, is shown in FIG. 5 by a broken line, and its cross-sectional contour is shown in FIG. 7 by a similar broken line.

Deformation of the hollow member 1, namely a decrease in volume, causes the subject liquid in the hollow member 1 to exit to the exterior of the pump through the exit tube 10. In the next process, the pressurizing means 3 evacuates the hydraulic fluid from the casing 2 and decreases the interior pressure of the casing. Thus, the hollow member 1 is allowed to restore its original cylindrical shape, while introducing an additional amount of subject liquid from the inlet 9 through a suction tube. This behavior is cyclically repeated to perform introduction and delivery of the subject liquid by the pump. That is, the cylindrical hollow member 1 reciprocally changes its form between the original circular shape and a depressed oval shape in its cross section to introduce and discharge the subject liquid.

Sites of depression (deformation) and restoration of the hollow member 1 are determined by the guide means explained below. The sites of depression of the hollow member are not random but are determined by positions where the bars (contact elements) 4*c* of the guide means 4 contact.

When the hollow member 1 bulges with the introduced subject liquid, its circumferential wall urges the bars (contact elements) 4*c* so as to expand them radially outwardly, and causes them to contact the inner wall of the casing 2. In this status, inner ends of the bars 4*c* contact the outer circumferential wall of the hollow member 1, and slightly depress and deform the contact portions of the hollow member 1. When the pressurized hydraulic liquid flows into the casing 2, the hollow member 1 deforms from the portions depressed by the bars (contact elements) 4*c*, until making a flat shape in its cross section.

Next explained are behaviors of the guide means 4 and the drive means 5, mainly referring to FIG. 4.

When discharge of the hydraulic fluid from the casing 2 is started, the fluid pressure in the cylinder 7 decreases as explained above, and permits the piston 8 to move with the aid of the atmospheric pressure. As a result, the catch 8*a* bonded to the distal end of the piston rod urges one of the projections 4*d*1 under current contact, and the ring-shaped ratchet wheel 4*a* rotates in the clockwise direction. Note here that rotation of the ring-shaped ratchet wheel 4*a* is executed prior to discharge of the hydraulic liquid from the casing 2 and introduction of the subject liquid into the hollow member 1. Therefore, when the ring-shaped ratchet wheel 4*a* should rotate, the contact elements 4*c* contact with the outer circumferential wall of the hollow member 1 with a moderate force which is weak enough to ensure smooth rotation of the ring-shaped ratchet wheel 4*a*.

When the hydraulic fluid is introduced into the casing 2, the piston 8 retreats due to the pressure of the fluid. Then, the catch 8*a* is released from the projection 4*d*1 and moves to the next projection 4*d*2 in the form of a ratchet mechanism.

In this process, the catch 8*a* can smoothly move beyond the projection 4*d*2 because of its reshaped configuration, and the longer bifurcated end of the catch 8*a* engages the projection 4*d*2.

When the piston 8 withdraws from the projection 4*d*l and the catch 8*a* moves beyond the next projection 4*d*2, counterclockwise rotation of the ring-shaped ratchet wheel 4*a* is prevented by the pawl 6.

Due to the above-explained behavior of the drive means 5, the ring-shaped ratchet wheel 4*a* of the guide means 4 rotates by the distance between two adjacent projections 4*d* in each cycle of depression and restoration of the hollow member 1. Since the rotation of the ring-shaped ratchet wheel 4*a* is accompanied by rotation of the contact elements 4*c* around the circumferential wall of the hollow member 1, deformed portions of the hollow member 1 change with rotation of the contact elements 4*c*.

Figure 7A:
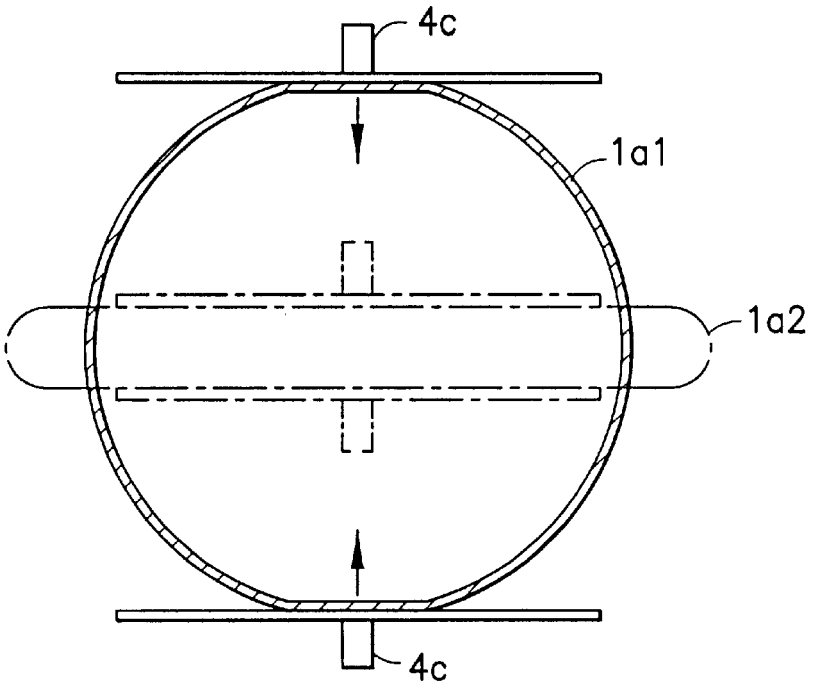
FIGS. 7A and 7B are diagrams showing positional relationship between contact elements of the guide means and deformed portions of the hollow member.
Figure 7B:
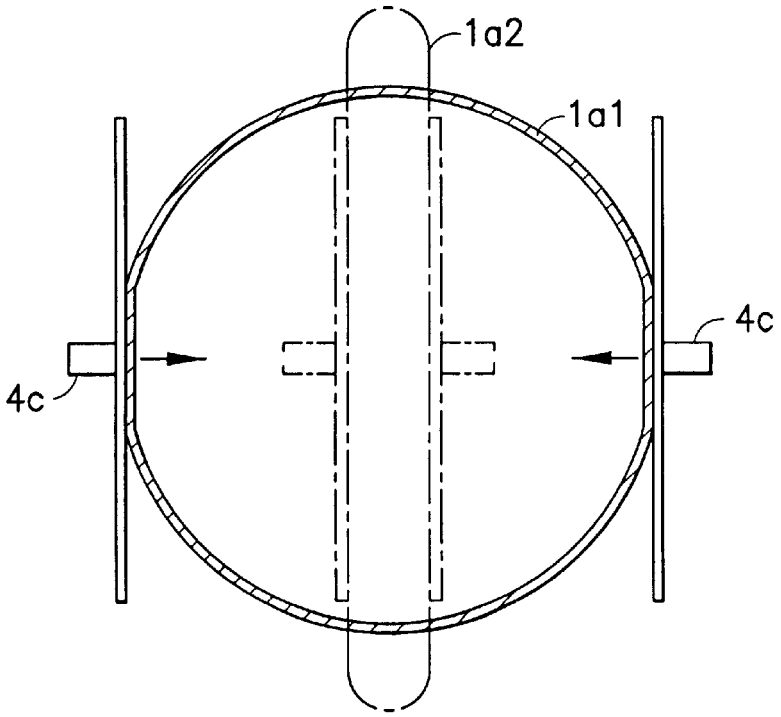

FIG. 7A and FIG. 7B are diagrams showing a relationship between positions of the contact elements 4*c* and deformed portions of the hollow member 1. In these drawings, 1*a*1 denotes a cross-sectional view of the outer circumferential wall of the hollow member 1 before deformation, and 1*a*2 denotes the same after deformation.

In FIG. 7A, bars (contact elements) 4*c*, 4*c* are located at 12 o'clock and 6 o'clock positions. When the pressurized hydraulic fluid is introduced into the casing 2, the circumferential wall 1*a*1 of the hollow member 1 is depressed and gradually deforms in the arrow-marked direction, until making the flat cross-sectional shape shown at 1*a*2. In FIG. 7B, the bars (contact elements) 4*c*, 4*c* are located at 3 o'clock and 9 o'clock positions. When the hydraulic fluid is introduced into the casing 2, the circumferential wall 1*a*1 of the hollow member 1 is depressed in the arrow-marked direction and gradually deforms until making the flat (oval) cross-sectional shape shown at 1*a*2.

In this manner, along with changes in position of the bars (contact elements) 4*c*, depressed portions of the circumferential wall of the hollow member 1 are shifted. In other words, stress-applied sites of the hollow member 1 are sequentially shifted by the bars (contact elements) 4*c*.

As referred to above, the ring-shaped ratchet wheel 4*a* used in this embodiment has 49 projections 4*d*, and the drive means 5 is configured to feed the projections 4*d* every three per cycle. Therefore, only after three revolutions of the ring-shaped ratchet wheel 4*a* (total feeding number of projections being 147), the bars (contact elements) 4*c* return to the initially located 49th positions. That is, while suction and discharge of the pump are repeated by 49 cycles, the circumferential wall 1*a* of the hollow member 1 deforms at 49×2=98 different sites, and the stress applied to the circumferential wall 1*a* of the hollow member 1 by deformation is distributed to 98 different portions:

In contrast, in conventional bellows pumps and others, stress by deformation always concentrates at constant portions even if the speed of suction and discharge of the pump is one hundred cycles per minute.

Therefore, when all the other conditions are equal, the life of the pump according to the present embodiment can be up to forty-nine times greater than conventional bellows or other type pumps. If projections 4*d* are increased to 101 and the drive means 5 feeds them every three projections, it results in 101×2=202 portions since the circumferential wall 1 is bent at two portions in one cycle.

The mechanical load applied to the bent portions of the hollow member 1 due to repetitive bending causes mechanical fatigue at the stress-applied portions, which often results in stress crack. The pump according to the embodiment, as compared with conventional diaphragm- or bellows-type pumps, is configured to disperse such stress to much more portions as a whole, and the life of the pump is proportionally longer. Thus, localized fatigue regions are avoided.

Specific gravities of the subject liquid and the hydraulic liquid are preferably similar. When the specific gravity of the subject liquid is relatively large, one of so-called heavy liquids having an appropriate specific gravity should be selected as the hydraulic fluid.

Figure 8:
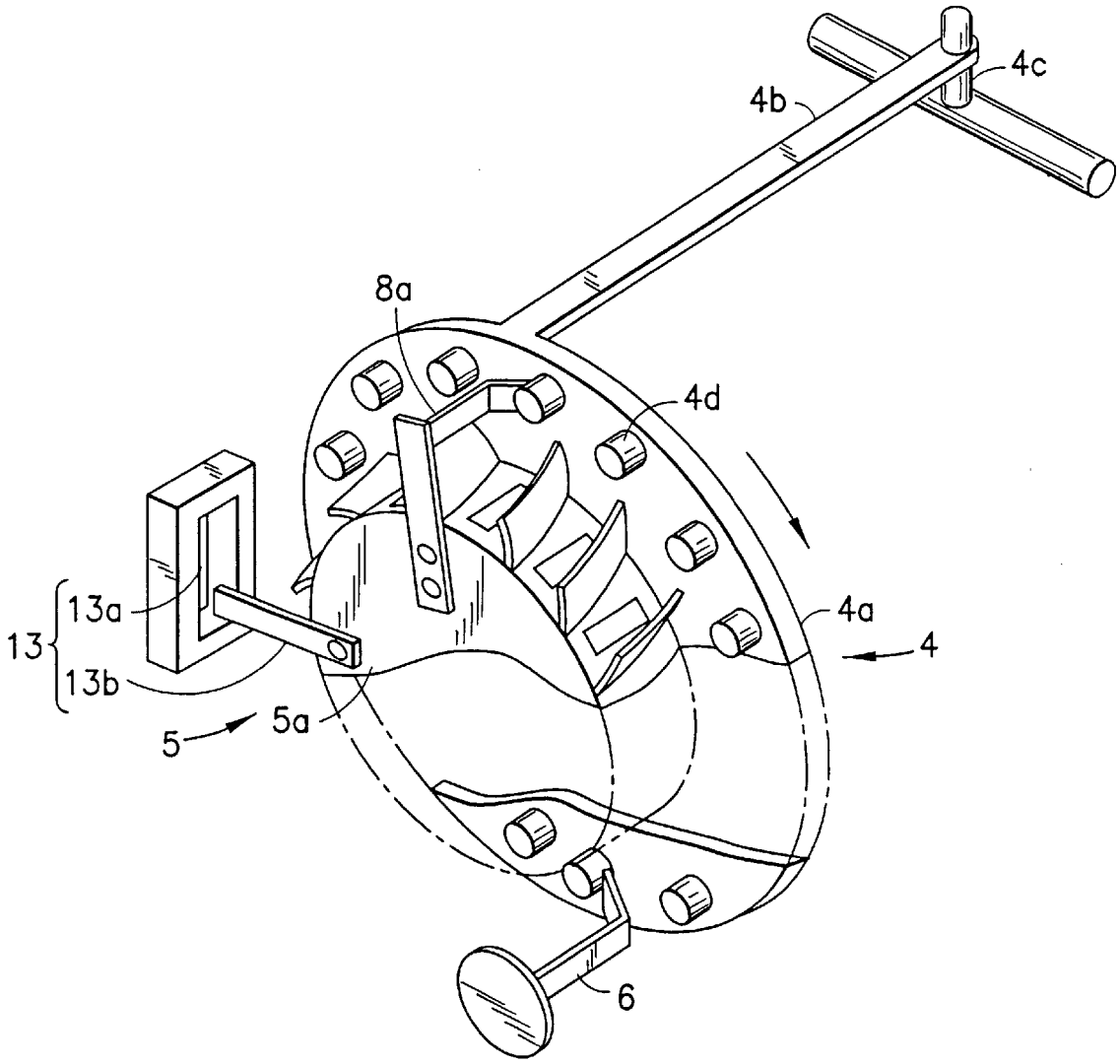
FIG. 8 is a perspective view showing another structure of the drive means.

Next explained is a pump taken as another embodiment of the invention with reference to FIG. 8. In this embodiment, the drive means 5 includes a turbine 5*a* rotated by a liquid from the pressurizing means 3 reciprocated in the casing 2, a catch 8*a* attached to the turbine 5*a*, a limiter 13, and a pawl 6. The turbine 5*a* rotates in the clockwise direction when the fluid exits the casing 2, and in the counterclockwise direction when the fluid enters the casing 2.

The turbine 5*a* is controlled in amount of rotation by the limiter 13, which includes a rod 13*b* attached to the turbine 5*a* and a regulating hole 13*a* for regulating the amount of rotation of the rod 13*b*. The number of the projections 4*d* fed by the catch 8*a* depends upon the size of the regulating hole 13*a*. Also, when the turbine 5*a* rotates in the reverse direction, the reverse rotation is stopped by the regulating hole 13*a* when the turbine 5*a* rotates by the feeding number of the projections 4*d*.

The pawl 6 is the same as that of the former embodiment. The drive source of the drive means 5 may be either the same as used in the former embodiment or any appropriate one of an electromagnetic solenoid, stepping motor, or super-slow motor with a large reduction gear ratio, such as 1 rpm or ⅓ rpm.

In this case, the guide means 4 for positional determination is rotated continuously. Thus, a variety of means may be used as the power source of the drive means 5.

Figure 9:
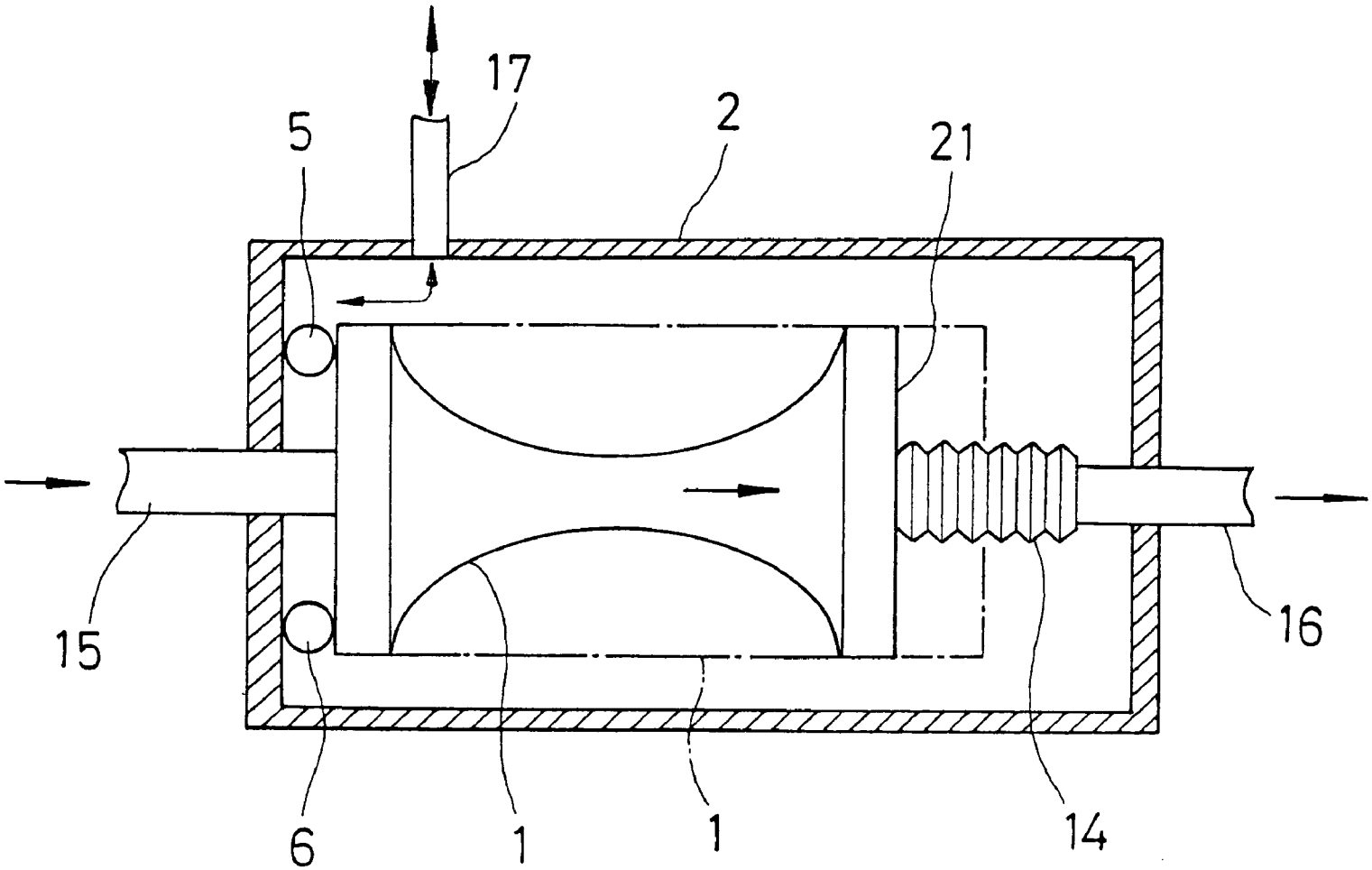
FIG. 9 is a cross-sectional view of a pump taken as another embodiment of the invention.

With reference to FIG. 9, a further embodiment of the present invention is explained.

In FIG. 9, numeral 15 denotes an inlet passage for introducing the subject liquid, and 16 is an outlet passage for delivery of the subject liquid. The outlet passage 16 is connected to an outlet formed in one end plate 21 of the hollow member 1 by a lengthwise-flexible bellows pipe. When the hydraulic liquid flows into the casing 2, the hollow member 1 contracts from the shape shown by the broken line to the shape shown at the solid line. Together with the contraction, the end plate 21 of the hollow member 1 also moves from the position shown by the broken line to the position shown by the solid line. When the hydraulic fluid withdraws from the casing 2, the end plate 21 returns to the original position. Movements of the end plate 21 are effected in a smooth manner by the bellow pipe 14. In this embodiment, the support device 12 shown in FIG. 1 is not required. A pressurizing means discussed previously for supplying and evacuating the hydraulic fluid is not specifically shown but can be provided at a convenient location in the casing 2. Details of the guide means 4 and the drive means 5 are omitted from FIG. 9 since they have the same construction and operation as those of the former embodiment.

Since the length of contraction and extension of the bellows in FIG. 9 is small, a long life is ensured.

In the embodiment described above, a pair of arms 4*b* of the guide means 4 are attached to the ring-shaped ratchet wheel 4*a* at radially opposite locations. However, three arms may be used. In this case, the hollow member 1 makes a triangle in its cross section when depressed (see FIG. 13)

If the subject liquid introduced and delivered by the pump is a strong acid such as hydrochloric acid, fluoric acid, fuming sulfuric acid or fuming nitric acid, it penetrates the circumferential wall of the hollow member made of polytetrafluoroethylene (TFE), polyethylene (PE), or the like, and mixes into the hydraulic fluid in the casing.

Although the permeable amount of the strong acid is very small, it accumulates over a long time, and may finally corrode the inner wall of the casing, connecting tube between the casing and the pressurizing means, piston of the pressurizing means, and others.

Figure 10:
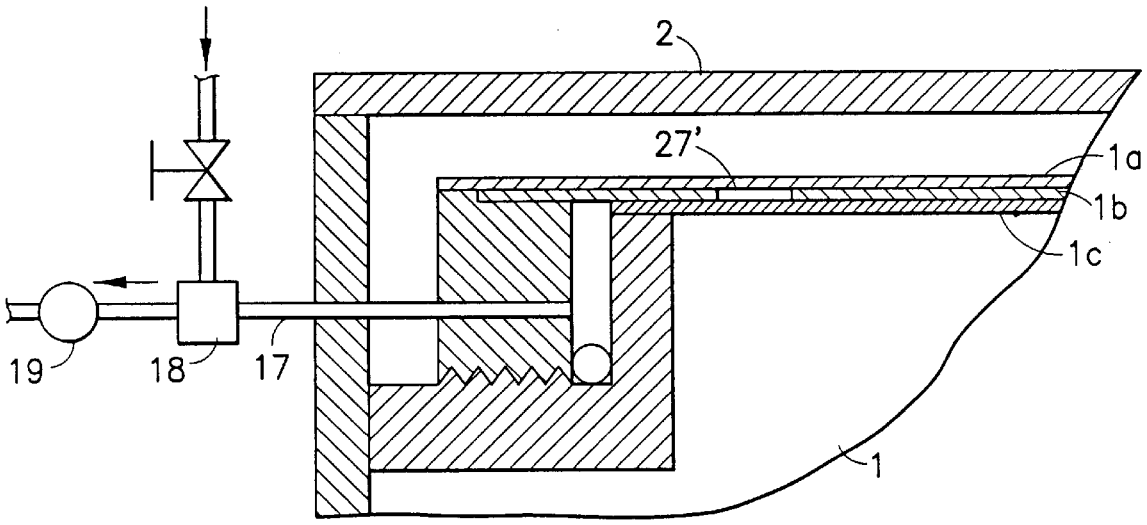
FIG. 10 is a cross-sectional view of a discharge device.

Therefore, the strong acid penetrating the circumferential wall of the hollow member must be discharged to the exterior of the pump before mixing with the hydraulic fluid. FIG. 10 is an embodiment of a pump having a drain for this purpose. In FIG. 10, the circumferential wall of the hollow member 1 includes an outer layer 1*a*, an inner layer 1*c*, and a fluid passage layer 1*b* interposed between the inner and outer layers.

The fluid passage layer 1*b* may be a braid material made of fibers of polytetrafluoroethylene (PTFE), polyethylene (PE), etc. or any other material which permits the fluid to pass through.

Numeral 17 denotes a drain tube with one end connected to the fluid passage layer 1*b* and the other end connected to a check valve outside the pump via a chamber 18 outside the pump.

The hydrochloric acid, or other strong acid, which penetrates from the interior of the hollow member 1 through the inner layer 1*c* of the circumferential wall into the fluid passage layer 1*b*, flows in the fluid passage layer 1*b*, and is discharged to the exterior of the pump via the drain tube 17 and the check valve 19. That is, the circumferential wall of the hollow member 1 is made of three layers. Upon introduction of the subject liquid (at the beginning of restoration of the hollow member i), a small amount of air is introduced into the fluid passage layer 1*b* through a needle valve, and upon delivery of the subject liquid (upon deformation of the hollow member 1) is discharged together with the hydrochloric acid, or other acid, due to the pressure from the hydraulic fluid.

In this manner, because of the drain system, the circumferential wall of the hollow member 1 effects operation similar to respiration. When the pump is large-scaled, respiration by the drain system may need the aid of an electromagnetic valve or other compulsory system (not shown).

In this embodiment, the drain system is provided at one end of the hollow member 1; however, the same system may be added to the other end of the hollow member 1 so as to use one for introducing air, pure water, or other fluid into the fluid passage layer and the other for discharging hydrochloric acid from the hollow member together with the intentionally introduced fluid.

A detector may be provided in the chamber 18 to monitor a leakage sensor 29 mounted in the multiple layers. In this case, if the inner layer of the circumferential wall is damaged, any leaked liquid will flow into the chamber due to the pressure of the hydraulic fluid. Therefore, such a damage can be detected, and appropriate measures can be taken immediately.

Figure 11:
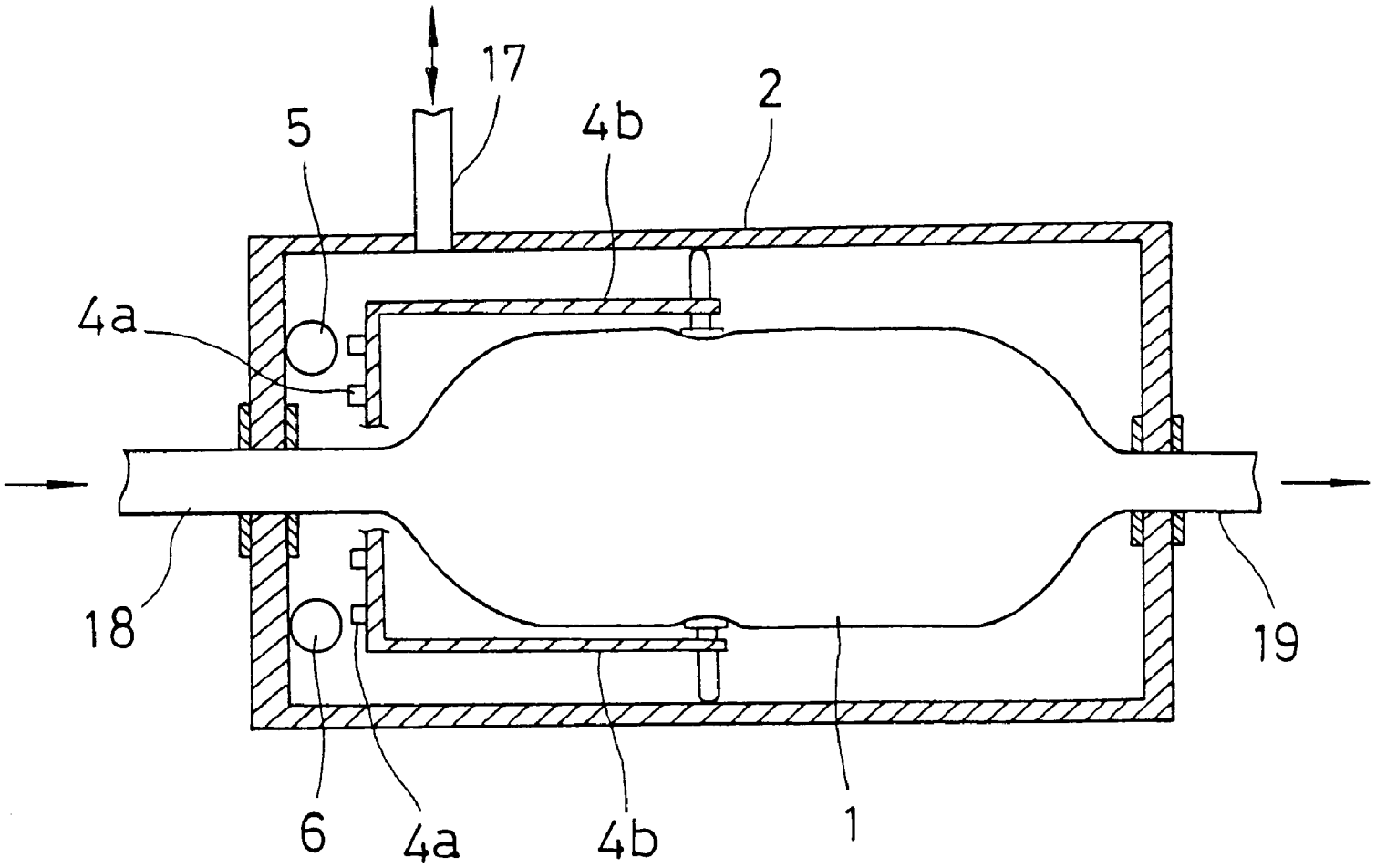
FIG. 11 is a cross-sectional view of a pump according to a further embodiment of the invention.

FIG. 11 is a diagram showing another version of the hollow member 1. In this embodiment, the hollow member 1 is made of an elastomer in an elongated spherical shape having an inlet tube 18 and an outlet tube 19 integrally extending from opposite ends. That is, the main body of the hollow member 1 includes a cylindrical portion, and gradually narrowed conical portions at opposite ends.

Because of the material and shape of the hollow member 1, deformation of the hollow member 1 due to introduction and delivery of the subject liquid by the pump, namely, lengthwise expansion and contraction of the hollow member 1, occur in the main body and do not affect the inlet tube 18 and the outlet tube 19 connected to opposite ends of the casing 2. Therefore, this embodiment needs no special support system as shown in FIG. 5. A pressurizing means discussed previously for supplying and evacuating the hydraulic fluid is not specifically shown but can be provided at a convenient location in the casing 2. Details of the guide means 4 and the drive means 5 are also omitted from FIG. 11 since they can have the same construction and operation as discussed previously.

Figure 12:
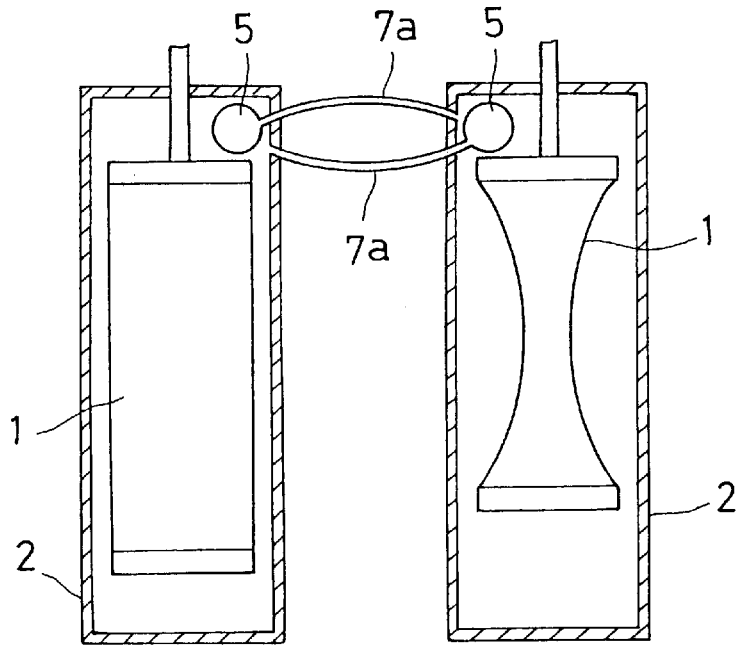
FIG. 12 is a diagram showing that pumps according to the invention are used in connection.

FIG. 12 is a diagram showing that two pumps according to the invention are connected. Numeral 5 denotes the drive means having a cylinder 7 as shown in FIG. 4. The cylinder 7 in one of the pumps is connected to the casing 2 of the other pump. The hydraulic fluid flowing into the casing 2 of one pump also flows into the cylinder 7 of the other pump, and activates its drive means 5.

Figure 13:
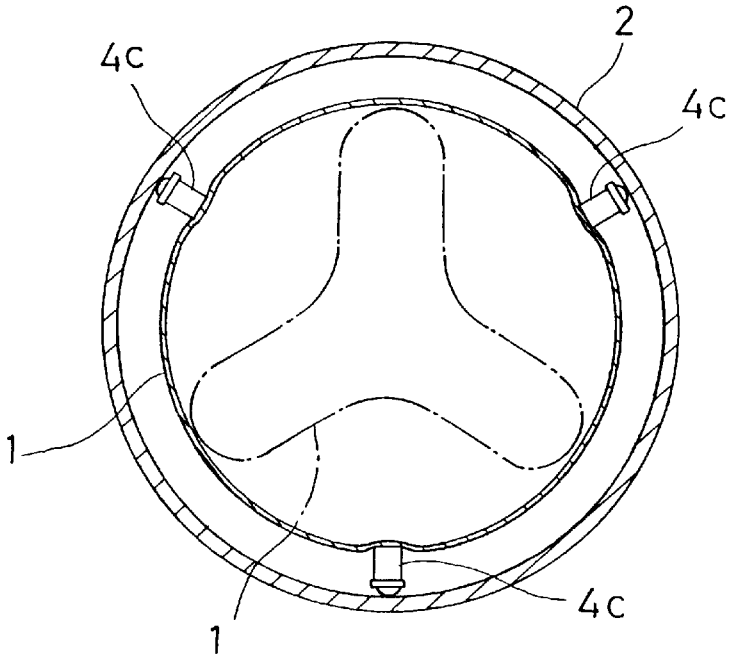
FIG. 13 is a diagram showing deformation of the hollow member when depressed at three portions of its outer circumferential wall.

FIG. 13 is a diagram showing deformation of the hollow member depressed at three portions of the circumferential wall. Depression of the hollow member results in decreasing and deforming its cross section into the illustrated shape.

Figure 14:
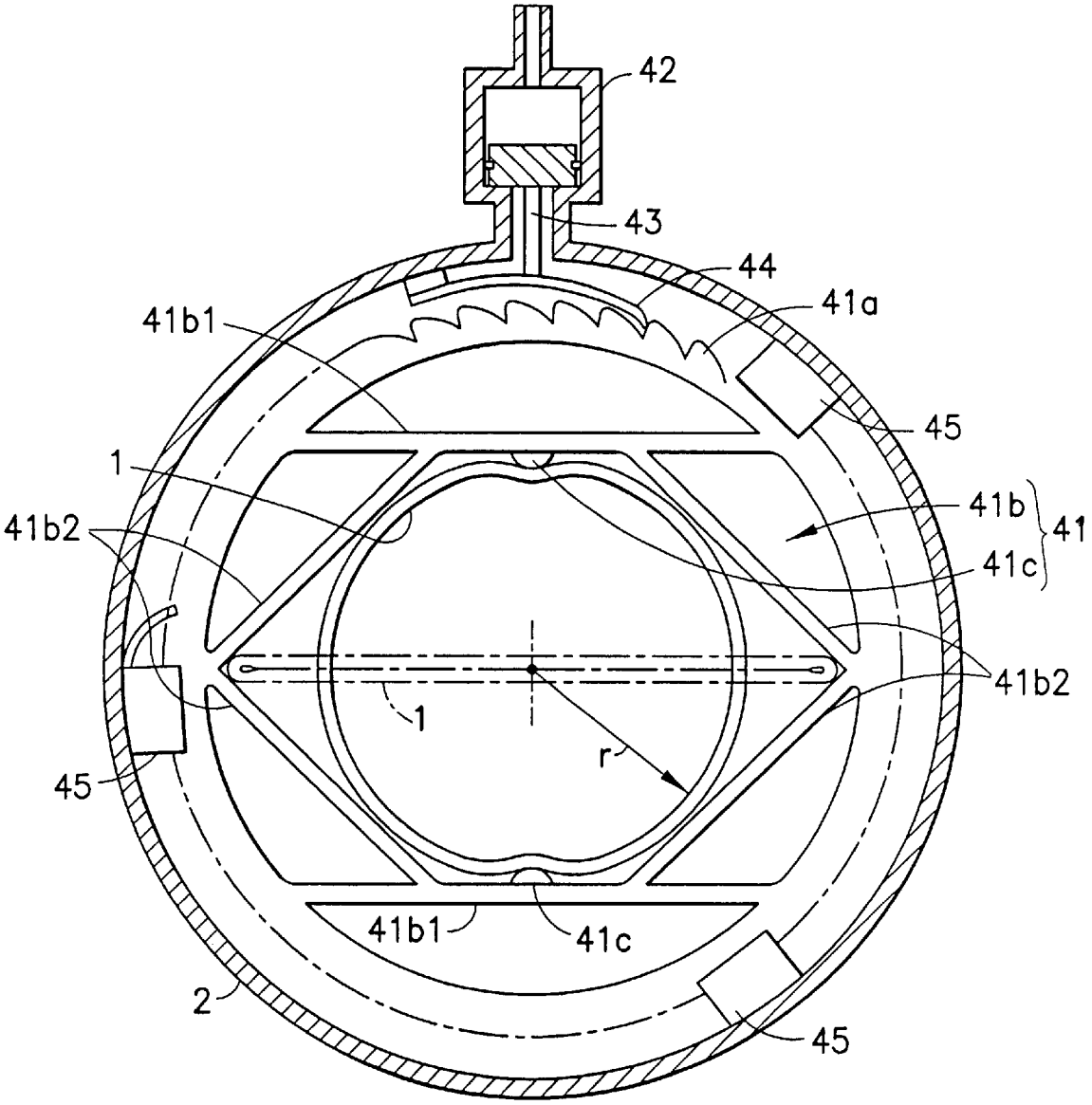
FIG. 14 is a cross-sectional view showing a pump taken as another embodiment of the invention.
Figure 15:
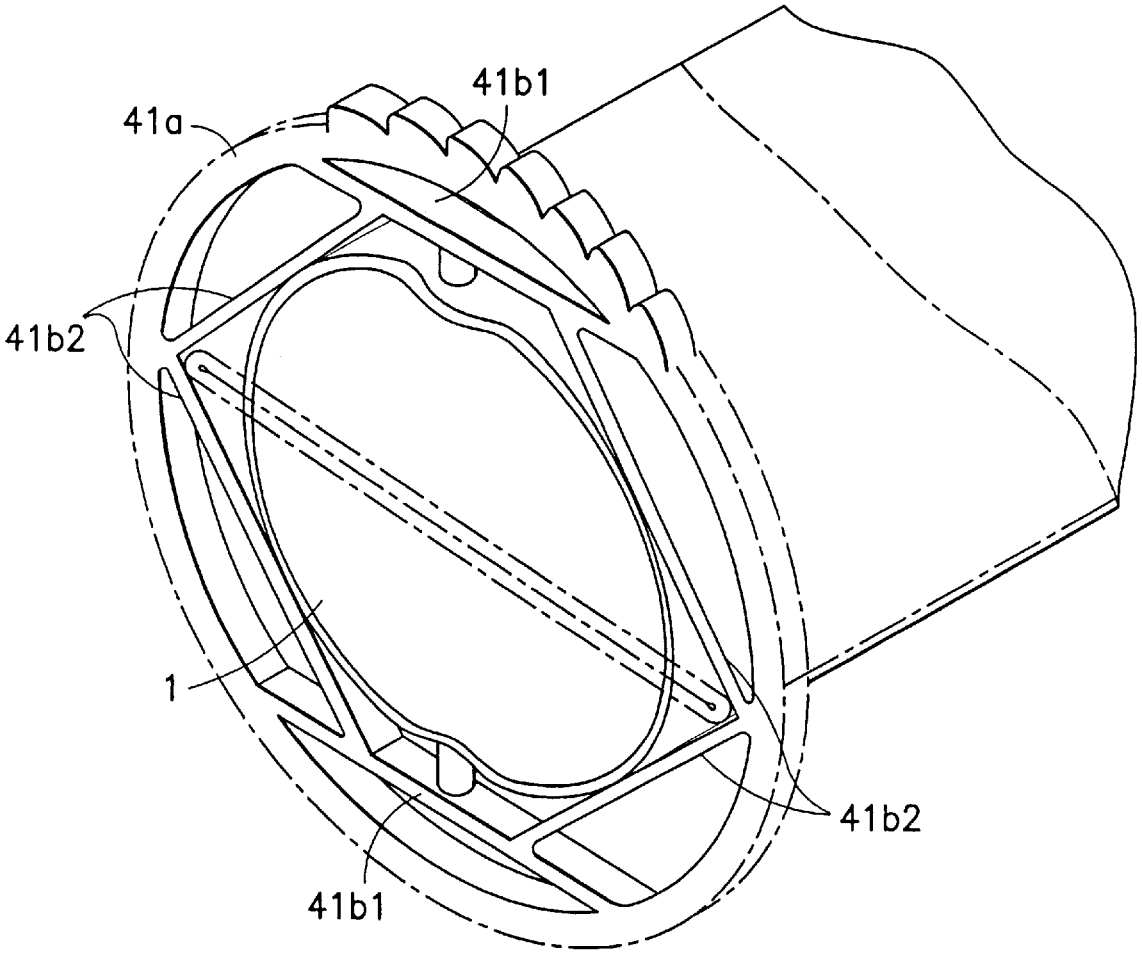
FIG. 15 is a fragmentary cross-sectional view of the pump shown in FIG. 14.

Referring to FIG. 14 and 15, further embodiments are explained. The hollow member 1 for introduction and delivery of the subject liquid by contraction and restoration of its volume has the same structure and material as those in the former embodiments. The casing 2 containing the hollow member 1 includes the same pressurizing means (not shown) as that of FIG. 1 for introducing and evacuating the hydraulic fluid to cause deformation of the hollow member 1. Numeral 41 denotes a deformation-inducing means which contacts the circumferential wall of the hollow member 1 to induce deformation of the hollow member to reduce its volume. The deformation-inducing means 41 includes a drive means for changing its position relative to the hollow member continuously or intermittently. The deformation-inducing means 41 further includes a frame-shaped member 41*b* which surrounds the hollow member 1 and regulates its deformation in predetermined directions, and pressing portions 41*c* formed in the frame-shaped member 41*b* to contact the circumferential wall of the hollow member 1 at radially opposite portions when the hollow member 1 expands.

In this embodiment, the frame-shaped member 41*b* has a pair of opposed straight portions 41*b*1, 41*b*1, and slanted portions 41*b*2 at opposite ends of the straight portions. The pressing portions 41*c* are formed on the straight portions 41*b*l. The frame-shaped member 41*b* is affixed to the inner wall of a ring-shaped ratchet wheel 41*a*.

The frame-shaped member used in this embodiment is explained below in greater detail. When the radius of the hollow member 1 is r, the frame-shaped member has an approximately square shape with a diagonal length of $2\sqrt{2}$. That is, the pair of straight portions are made by cutting off a pair of corners of an approximate square with a side of 2*r*, and the remainder four sides form the slanted portions. The hollow member 1, in its original shape, contracts inner surfaces of these four slanted portions.

The drive means includes a cylinder 42 and a piston 43. The piston 43 reciprocally moves in the cylinder 42 by the hydraulic fluid flowing to and from the casing 2, and engages with teeth on the ring-shaped ratchet wheel 41*a* via a catch 44 made of a spring member to rotate the ring-shaped ratchet wheel 41*a*.

The fluid inlet of the cylinder 42 is connected to a pressurizing means operative in the opposite phase from the phase of the pressurizing means for supplying the hydraulic fluid to the hollow member 1. Thus, the piston 43 is reciprocated by the hydraulic fluid supplied to the hollow member 1 and the hydraulic fluid supplied to the cylinder 42.

As shown in FIG. 12, the fluid inlet of the cylinder 42 may be connected to the hollow member 1 of another pump operative in the opposite phase. Here again, the piston 43 can reciprocate in the same manner as explained above.

The catch 44 made of a spring member has an arcuate configuration having one end secured to the inner wall of the casing 2 and the other end in engagement with the teeth on the ring-shaped ratchet wheel 41*a*.

Numeral 45 denotes a guide affixed to the inner wall of the casing 2 to support the ring-shaped ratchet wheel 41*a*. Three guides 45 are attached at equal intervals, and each has a guide in which the marginal portion of the ring-shaped ratchet wheel 41*a* can rotate.

Explained below is the behavior of the pump having the above-explained construction. When the hydraulic fluid flows into the casing from the pressurizing means (not shown), the hollow member 1 filled with the subject liquid is induced to gradually deform and reduce its volume until making the flat shape shown by an imaginary line in the drawings. As a result, the subject liquid within the hollow member 1 is delivered to the exterior (i.e. external to the pump).

While the contracting deformation of the hollow member 1 progresses, its circumferential wall keeps contact with four portions, or at least at two portions, of the slanted sides 41*b*2 of the frame-shaped member 41*b*. Therefore, the hollow member 1 is depressed into a flat shape extending along the diagonal line which connects the corner between two adjacent slanted sides 41*b*2 and the corner between the other two adjacent slanted sides 41*b*2 as shown in FIGS. 14 and 15. That is, the direction of depression of the hollow member 1 can be determined by the frame-shaped member.

If the frame-shaped member is not used, the direction of depression will be random due to unevenness in thickness of the circumferential wall of the hollow member, or other factors.

As the hydraulic fluid is evacuated from the casing 2, which decreases the pressure within the casing 2, an additional amount of subject liquid flows into the hollow member 1, and the hollow member 1 gradually restores its original circular shape from the flat shape in its cross section. During restoration of the circular shape from the flat shape of the hollow member 1, the piston 43 moves downward due to a supply of the hydraulic liquid to the cylinder 42, and its head urges the catch 44. Therefore, the tip of the catch 44 urges teeth on the ring-shaped ratchet wheel, and the wheel 41*a* in rotational engagement with the guides 45 is rotated together with the frame-shaped member 41*b* attached to the inner side thereof. The rotation causes a change in contact points of the pressing portions 41*c* relative to the hollow member and a change in depressed portion of the hollow member 1.

Figure 16:
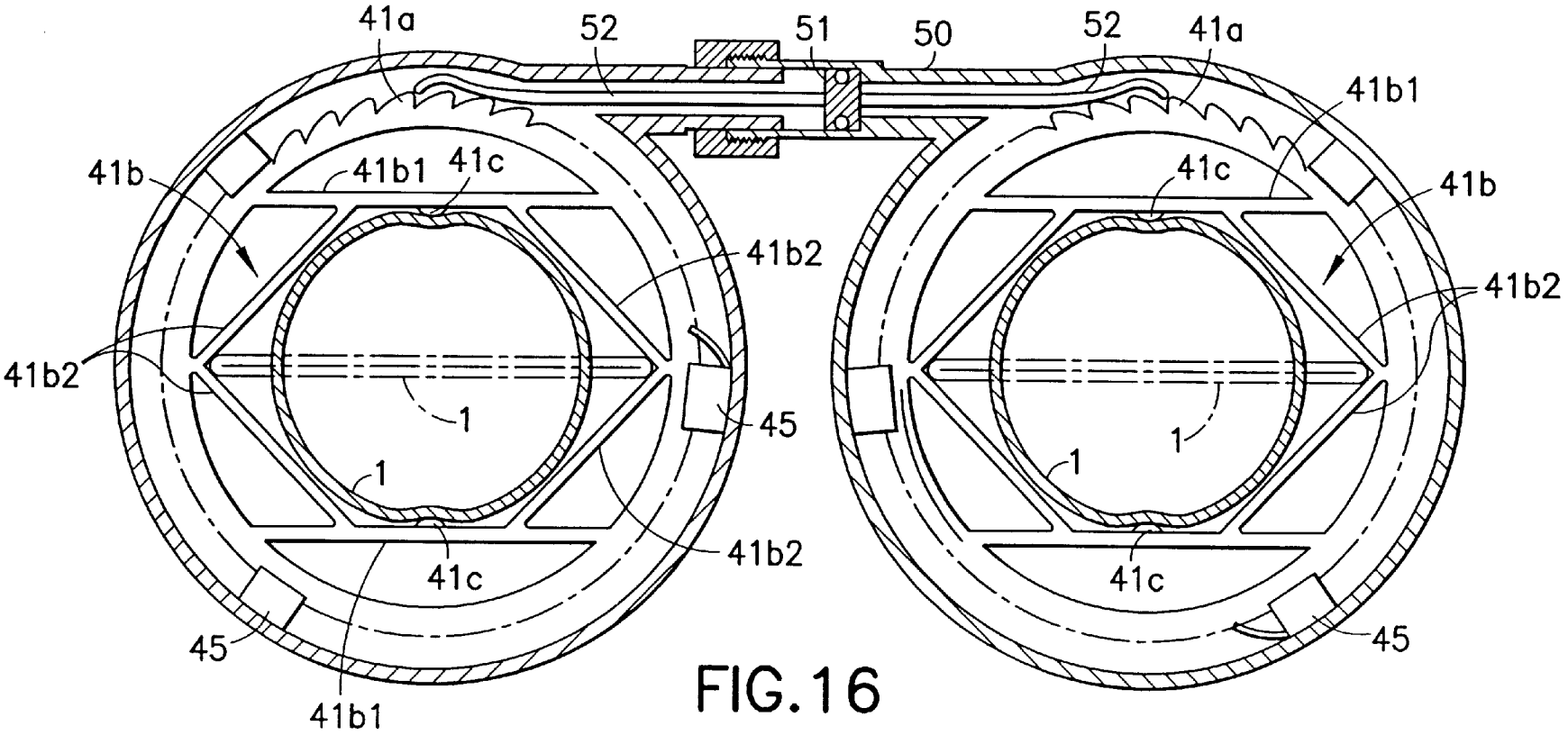
FIG. 16 is a cross-sectional view showing a pump system taken as a further embodiment of the invention.

FIG. 16 shows a different version of the embodiment shown in FIGS. 14 and 15 in construction. Equivalent elements are labeled with the same reference numerals, and their explanation is omitted to avoid redundancy. In this embodiment, the casings 2 are connected by a cylinder 50. A piston 51 reciprocating in the cylinder 50 has straight-extending catches 52 having hooked ends in engagement with the ring-shaped ratchet wheel 41*a*. The piston 51 reciprocates in the cylinder 50 due to a flow of the hydraulic fluid to and from the casing 2 and rotates the ring-shaped ratchet wheel 5 via the catch 52. The other behaviors are the same as those of the former embodiment.

Figure 17:
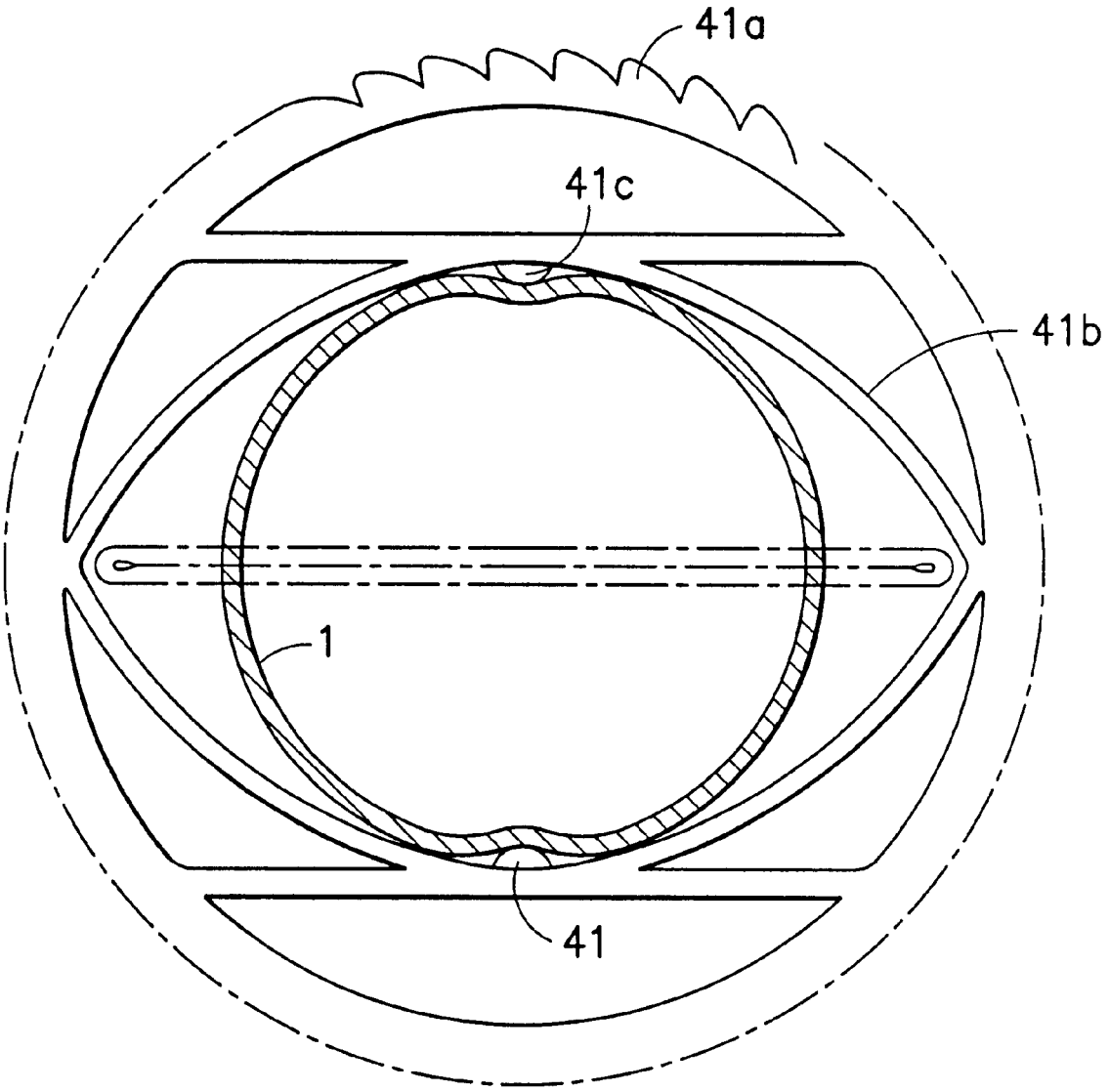
FIG. 17 is a cross-sectional view of a pump taken as a still further embodiment of the invention.

FIG. 17 is a diagram showing another version of the frame-shaped member 41*b*. In this embodiment, the frame-shaped member 41*b* is approximately oval, or eye-shaped, and its pressing portions 41*c* are formed at points where the oval peripheral line merges the shortest diametric line of the oval, e.g., at the lengthwise mid-point of the oval. The term "oval" as used herein is thus meant to encompass ellipsoids, egg-shapes, eye-shapes, and other gradually elongated, generally symmetrical shapes. In the other respects, this embodiment is the same as the former.

Accordingly, it can be seen that the present invention provides a pump for introduction and delivery of a subject liquid. The pump includes a hollow member on which the stress due to the repeated depression and restoration is imposed symmetrically to prolong the life of the hollow member. In particular, the initial contraction position of the hollow member is varied every n cycles of contraction and restoration of said hollow member, where $n \geqq 1$.

Although the invention has been described in connection with various specific embodiments, it will be appreciated by those skilled in the art that numerous adaptations and modifications may be made thereto without departing from the spirit and scope of the invention as set forth in the claims.

What is claimed is:

1. A positive displacement pump apparatus, comprising:

a hollow member for delivering a subject liquid by a cycle of contraction and restoration of its volume;

a casing containing said hollow member;

a pressurizing means for supplying and evacuating a hydraulic liquid between said casing and said hollow member, said supplying of hydraulic fluid causing said contraction of said hollow member, and said evacuating of said hydraulic fluid causing said restoration of said hollow member;

a guide means for contacting and deforming outer circumferential portions of said hollow member during said restoration to determine an initial contraction position of said hollow member; and drive means for varying the circumferential position of said guide means relative to said hollow member to vary an initial contraction position of said hollow member.

2. The apparatus of claim 1, wherein said casing is a cylindrical element comprising at least one of a metal and a hard resin material; and said hollow member is a cylindrical element comprising at least one of an elastomer and a flexible resin.

3. The apparatus of claim 2, wherein said cylindrical hollow member deforms from a circular cross-sectional shape during said restoration to one of (a) an approximately oval cross-sectional shape and (b) an approximately triangular cross-sectional shape during said contraction, and again to the circular cross-sectional shape during the next restoration.

4. The apparatus of claim 3, wherein said guide means comprises:

a ring-shaped ratchet wheel being mounted at one end of said cylindrical hollow member;

at least two arms attached to said ring-shaped ratchet wheel; and a contact element formed at an end of each of said arms to contact the outer circumferential portions of said hollow member during said restoration to determine the initial contraction position of said hollow member.

5. The apparatus of claim 4, wherein said drive means comprises:

a ratchet mechanism which is adapted to rotate said ring-shaped ratchet wheel by engagement of a catch with at least one or a plurality of projections formed on said ring-shaped ratchet wheel;

said ratchet mechanism further comprising a pawl for preventing reverse rotation of said ring-shaped ratchet wheel.

6. The apparatus of claim 5, wherein:

said ratchet mechanism comprises a cylinder and a piston reciprocally mounted in said cylinder for causing said catch to engage said at least one of a plurality of projections; and said piston is operable by the supplying and evacuation of the hydraulic fluid between said casing and said hollow member.

7. The apparatus of claim 5, wherein:

said ratchet mechanism comprises a turbine for causing said catch to engage said at least one of a plurality of projections; and said turbine is operable by the hydraulic fluid flowing between said casing and said hollow member.

8. The apparatus of claim 2, wherein:

said cylindrical hollow member has a circumferential wall having a plurality of layers comprised of at least one of an elastomer and a flexible resin; and a fluid passage layer is interposed within said plurality of layers.

9. The apparatus of claim 8, further comprising:

a drain system for discharging the subject liquid when in case the subject liquid penetrates said circumferential wall of said hollow member;

said drain system having one open end communicating with a space between outer and inner layers of said circumferential wall, and having another end in the form of a drain tube connected to a valve outside said casing;

such that at least part of the subject liquid which penetrates from the inner layer to said fluid passage layer is discharged through said drain system.

10. The apparatus of claim 9, wherein:

said drain tube is equipped with a leakage sensor.

11. The apparatus of claim 1, wherein:

said drive means varies the circumferential position of said guide means relative to said hollow member so that stresses borne by said hollow member due to successive cycles of contraction and restoration of said hollow member are dispersed.

12. The apparatus of claim 1, wherein:

said drive means varies an initial contraction position of said hollow member for every $n \geqq 1$ cycles of contraction and restoration of said hollow member.

13. The apparatus of claim 1, wherein:

said hollow member has a first end which is fixed relative to the casing and an opposing second end which is axially moveable relative to a longitudinal axis in the casing during the cycle of contraction and restoration.

14. The apparatus of claim 1, further comprising:

a suction tube for supplying the subject liquid to the hollow member;

said suction tube extending into and beyond a central portion of said hollow member to discourage retention of the subject liquid in said hollow member.

15. A positive displacement pump apparatus, comprising:

a hollow member for delivering a subject liquid by a cycle of contraction and restoration of its volume;

a casing containing said hollow member;

said hollow member comprising a first end with an inlet passage for receiving the subject liquid and an opposing second end with an outlet passage for delivering the subject liquid;

said second end comprising a plate which is axially moveable relative to a longitudinal axis in the casing during the cycle of contraction and restoration;

said outlet passage extending through a lengthwise-flexible bellows that is coupled to said plate; and a pressurizing means for supplying and evacuating a hydraulic liquid between said casing and said hollow member, said supplying of hydraulic fluid causing said contraction of said hollow member, and said evacuating of said hydraulic fluid causing said restoration of said hollow member.

16. The apparatus of claim 15, further comprising:

a guide means for contacting and deforming outer circumferential portions of said hollow member during said restoration to determine an initial contraction position of said hollow member; and drive means for varying the circumferential position of said guide means relative to said hollow member to vary an initial contraction position of said hollow member.

17. The apparatus of claim 16, wherein:

said drive means varies the circumferential position of said guide means relative to said hollow member so that stresses borne by said hollow member due to successive cycles of contraction and restoration of said hollow member are dispersed.

18. The apparatus of claim 16, wherein:

said drive means varies an initial contraction position of said hollow member for every $n \geqq 1$ cycles of contraction and restoration of said hollow member.

19. A positive displacement pump apparatus, comprising:

a hollow member for delivering a subject liquid by a cycle of contraction and restoration of its volume;

a casing containing said hollow member;

a pressurizing means for supplying and evacuating a hydraulic liquid between said casing and said hollow member, said supplying of hydraulic fluid causing said contraction of said hollow member, and said evacuating of said hydraulic fluid causing said restoration of said hollow member;

a deformation-inducing means for contacting and deforming outer circumferential portions of said hollow member during said restoration to determine an initial contraction position of said hollow member; and drive means for varying the circumferential position of said deformation-inducing means relative to said hollow member to vary the initial contraction position of said hollow member;

said deformation-inducing means including (a) a frame-shaped member rotatably surrounding said hollow member to regulate a direction of deformation of said hollow member, and (b) pressing portions formed on said frame-shaped member to contact opposite positions of said hollow member during restoration of said hollow member.

20. The apparatus of claim 19, wherein:

said casing is a cylindrical element comprising at least one of a metal and a hard resin material; and said hollow member is a cylindrical element comprising at least one of an elastomer and a flexible resin.

21. The apparatus of claim 20, wherein:

said cylindrical hollow member deforms from a circular cross-sectional shape during said restoration to an approximately oval cross-sectional shape during said contraction, and again to the circular cross-sectional shape during the next restoration.

22. The apparatus of claim 21, wherein said frame-shaped member includes a pair of approximately parallel straight portions on which said pressing portions are formed.

23. The apparatus of claim 21, wherein:

said frame-shaped member has an approximately oval shape; and said pressing portions are formed approximately at a lengthwise mid-point of the oval shape.

24. The apparatus of claim 20, wherein said drive means comprises:

a ratchet mechanism having a ring-shaped ratchet wheel surrounding said hollow member;

a catch;

a cylinder and a piston reciprocally mounted in said cylinder for rotating said ring-shaped ratchet wheel by causing said catch to engage at least one of a plurality of teeth formed on said ratchet wheel;

said ratchet mechanism further comprising a pawl for preventing reverse rotation of said ring-shaped ratchet wheel; wherein:

said piston is operable by the supplying and evacuation of the hydraulic fluid between said casing and said hollow member.

25. The apparatus of claim 24, wherein:

said frame-shaped member is attached to an inner circumferential wall of said ring-shaped ratchet wheel.

26. The apparatus of claim 20, wherein:

said cylindrical hollow member has a circumferential wall having a plurality of layers comprised of at least one of an elastomer and a flexible resin; and a fluid passage layer is interposed within said plurality of layers.

27. The apparatus of claim 26, further comprising:

a drain system for discharging the subject liquid in case the subject liquid penetrates said circumferential wall of said hollow member;

said drain system having one open end communicating with a gap between outer and inner layers of said circumferential wall, and having another end in the form of a drain tube connected to a valve outside said casing;

such that at least part of the subject liquid which penetrates from the inner layer to said fluid passage layer is discharged through said drain system.

28. The apparatus of claim 27, wherein:

said drain tube is equipped with a leakage sensor.

29. The apparatus of claim 19, wherein:

said drive means varies the circumferential position of said deformation-inducing means relative to said hollow member so that stresses borne by said hollow member due to successive cycles of contraction and restoration of said hollow member are dispersed.

30. The apparatus of claim 19, wherein:

said drive means varies the initial contraction position of said hollow member for every $n \geqq 1$ cycles of contraction and restoration of said hollow member.

* * * * *